US005176992A

United States Patent [19]

Maskasky et al.

[11] Patent Number: 5,176,992

[45] Date of Patent: Jan. 5, 1993

[54] PROCESS FOR THE PREPARATION OF A GRAIN STABILIZED HIGH CHLORIDE TABULAR GRAIN PHOTOGRAPHIC EMULSION (II)

[75] Inventors: Joe E. Maskasky; Yun C. Chang, both of Rochester, N.Y.

[73] Assignee: Eastman Kodak Company, Rochester, N.Y.

[21] Appl. No.: 820,181

[22] Filed: Jan. 13, 1992

[51] Int. Cl.[5] ..... G03C 1/07; G03C 1/035

[52] U.S. Cl. ..... 430/569; 430/567; 430/614; 430/615

[58] Field of Search ..... 430/567, 569, 600, 614, 430/615

[56] References Cited

U.S. PATENT DOCUMENTS

| | | | |
|---|---|---|---|
| 4,400,463 | 8/1983 | Maskasky | 430/434 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,942,120 | 7/1990 | King et al. | 430/567 |
| 4,952,491 | 8/1990 | Nishikawa et al. | 430/570 |
| 4,983,508 | 1/1991 | Ishiguro et al. | 430/569 |
| 5,035,992 | 7/1991 | Houle et al. | 430/569 |

FOREIGN PATENT DOCUMENTS

3/116133 5/1991 Japan .

OTHER PUBLICATIONS

Research Disclosure, vol. 308, Dec. 1989, Item 308119.

*Primary Examiner*—Charles L. Bowers, Jr.
*Assistant Examiner*—Mark F. Huff
*Aitorney, Agent, or Firm*—Carl O. Thomas

[57] ABSTRACT

A process is disclosed of preparing an emulsion for photographic use comprising forming in the presence of an xanthinoid grain growth modifier an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver. After the emulsion is formed, the pH of the emulsion is lowered to inactivate xanthinoid grain growth modifier, and the inactivated xanthinoid is replaced on the tabular grain surfaces by adsorption of a photographically useful compound chosen to contain at least one divalent sulfur atom, thereby concurrently morphologically stabilizing the tabular grains and enhancing their photographic utility.

11 Claims, No Drawings

PROCESS FOR THE PREPARATION OF A GRAIN STABILIZED HIGH CHLORIDE TABULAR GRAIN PHOTOGRAPHIC EMULSION (II)

FIELD OF THE INVENTION

The invention is directed to a process of preparing for photographic use high chloride tabular grain emulsions.

DEFINITION OF TERMS

The term "high chloride" refers to silver halide grains or emulsions in which chloride accounts for at least 50 mole percent of total halide, based on silver.

The term "morphological stabilization" refers to stabilizing the geometrical shape of a grain.

The term "stabilizer" is employed in its art recognized usage to designate photographic addenda that retard variances in emulsion sensitometric properties.

The term "tabular grain" is employed to designate grains having two parallel major faces lying in {111}crystallographic planes.

The terms "monolayer coverage" and "monomolecular layer" are employed in their art recognized usage to designate the calculated concentration of an adsorbed species that, if uniformly distributed on emulsion grain surfaces, would provide a layer of one molecule thickness.

The term "photographically useful compound" refers to compounds (i.e., addenda) that function during the storage, exposure and/or processing of photographic elements to enhance their image forming properties.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and bromoiodide emulsions. Although known and used for many years for selected photographic applications, the more rapid developability and the ecological advantages of high chloride emulsions have provided an impetus for employing these emulsions over a broader range of photographic applications.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multiemulsion layer formats, can be realized by increasing the proportions of selected tabular grain populations in photographic emulsions.

In almost every instance tabular grain emulsions have been formed by introducing two or more parallel twin planes into octahedral grains during their preparation. Regular octahedral grains are bounded by {111} crystal faces. The predominant feature of tabular grains formed by twinning are opposed parallel {111} major crystal faces. The major crystal faces have a three fold symmetry, typically appearing triangular or hexagonal.

The formation of tabular grain emulsions containing parallel twin planes is most easily accomplished in the preparation of silver bromide emulsions. The art has developed the capability of including photographically useful levels of iodide. The inclusion of high levels of chloride as opposed to bromide, alone or in combination with iodide, has been difficult. Silver chloride differs from silver bromide in exhibiting a much stronger propensity toward the formation of grains with faces lying in {100} crystographic planes. To produce successfully a high chloride tabular grain emulsion by twinning, conditions must be found that favor both the formation of twin planes and {111} crystal faces. Further, after the emulsion has been formed, tabular grain morphological stabilization is required to avoid reversion of the grains to their favored more stable form exhibiting {100} crystal faces. When high chloride tabular grains having (111} major faces undergo morphological reversion to forms presenting {100} grain faces the tabular character of the grains is either significantly degraded or entirely destroyed and this results in the loss of the photographic advantages known to be provided by tabular grains.

Maskasky U.S. Pat. No. 4,400,463 (hereinafter designated Maskasky I) was the first to prepare in the presence of an adsorbed grain growth modifier a high chloride emulsion containing tabular grains with parallel twin planes and {111} major crystal faces. The strategy was to use a particularly selected synthetic polymeric peptizer in combination with an adsorbed aminoazaindene, preferably adenine, acting as a grain growth modifier.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene grain growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent, King et al U.S. Pat. No. 4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. As grain growth modifiers, Tufano et al U.S. Pat. No. 4,804,621 employed 4,6-di(hydroamino)pyrimidines lacking a 5-position amino substituent (a 2-hydroaminoazine species); Japanese patent application 03/116,133, published May 17, 1991, employed adenine (a 2-hydroaminoazine species) in the pH range of from 4.5 to 8.5; Takada et al U.S. Pat. No. 4,783,398 employed heterocycles containing a divalent sulfur ring atom; Nishikawa et al U.S. Pat. No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

In the foregoing patents there is little or no mention of stabilizing the tabular grain shape in the high chloride emulsions, since the continued presence of conditions favorable for stabilizing the {111} major faces of the tabular grains, usually the presence of a 2-hydroaminoazine, is assumed. Houle et al U.S. Pat. No. 5,035,992 specifically addresses the problem of stabilizing high chloride tabular grain emulsions prepared in the presence of a 4,6-di(hydroamino)-pyrimidines lacking a 5-position amino substituent. Houle et al accomplished stabilization during tabular grain precipitation by continuously increasing the ratio of bromide to chloride being precipitated until the tabular grains were provided with stabilizing silver bromide shells. The Houle et al process is, of course, incompatible with producing a pure chloride emulsion, since at least some silver bromide must be included, and the process also has the disadvantage that the pyrimidine is left on the grain surfaces. Additionally, the grains remain morphologically unstable when their pH is lowered to remove the pyrimidine.

The emulsion teachings noted above either explicitly or implicitly suggest utilization of the emulsions with conventional grain adsorbed and unadsorbed addenda. A relatively recent summary of conventional photographic emulsion addenda is contained in Research Disclosure Vol. 308, December 1989, Item 308119. Research Disclosure is published by Kenneth Mason Publications, Ltd., Emsworth, Hampshire P010 7DD, England. While a wide variety of emulsion addenda can be adsorbed to grain surfaces, spectral sensitizing dyes and desensitizers (Res.Dis. Section IV) and antifoggants and stabilizers (Res.Dis. Section VI) are examples of photographically useful addenda that are almost always adsorbed to grain surfaces.

RELATED PATENT APPLICATIONS

Maskasky U.S. Serial No. 762,971, filed Sep. 20, 1991, commonly assigned, titled IMPROVED PROCESS FOR THE PREPARATION OF HIGH CHLORIDE TABULAR GRAIN EMULSIONS (II), (hereinafter designated Maskasky III) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

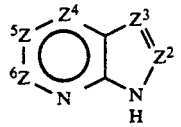

where $Z^2$ is —C($R^2$)= or —N=;

$Z^3$ is —C($R^3$)= or —N=;

$Z^4$ is —C($R^4$)= or —N=;

$Z^5$ is —C($R^5$)= or —N=;

$Z^6$ is —C($R^6$)= or —N=;

with the proviso that no more than one of $Z^4$, $Z^5$ and $Z^6$ is —N=;

$R^2$ is H, $NH_2$ or $CH_3$;

$R^3$, $R^4$ and $R^5$ are independently selected, $R^3$ and $R^5$ being hydrogen, hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

Maskasky U.S. Ser. No. 819,712, filed concurrently herewith. (as a continuation-in-art of U.S. Ser. No. 763,382, now abandoned, filed Sep. 20, 1991) and commonly assigned, titled IMPROVED PROCESS FOR THE PREPARATION OF HIGH CHLORIDE TABULAR GRAIN EMULSIONS (IV), (hereinafter designated Maskasky IV) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a triaminopyrimidine grain growth modifier containing mutually independent 4, 5 and 6 ring position amino substituents with the 4 and 6 ring position substituents being hydroamino substituents.

Maskasky U.S. Ser. No. 820,168, filed concurrently herewith (as a continuation-in-art of U.S. Ser. No. 763,382, now abandoned, filed Sep. 20, 1991) and commonly assigned, titled IMPROVED PROCESS FOR THE PREPARATION OF HIGH CHLORIDE TABULAR GRAIN EMULSIONS (V), (hereinafter designated Maskasky V) discloses a process for preparing a high chloride tabular grain emulsion in which silver ion is introduced into a gelatino-peptizer dispersing medium containing a stoichiometric excess of chloride ions of less than 0.5 molar, a pH of at least 4.6, and a grain growth modifier of the formula:

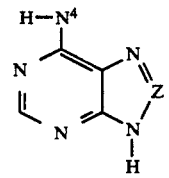

where $N^4$ is an amino moiety and

Z represents the atoms completing a 5 or 6 member ring.

Maskasky and Chang U.S. Ser. No. 763,013, filed Sep. 20, 1991, commonly assigned, titled IMPROVED PROCESS FOR THE PREPARATION OF HIGH CHLORIDE TABULAR GRAIN EMULSIONS (III), (hereinafter designated Maskasky et al) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

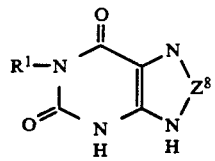

where $Z^8$ is —C($R^8$)= or —N=;

$R^8$ is H, $NH_2$ or $CH_3$; and $R^1$ is hydrogen or a hydrocarbon containing from 1 to 7 carbon atoms.

Maskasky U.S. Ser. No. 820,182, filed concurrently herewith (as a continuation-in-part of U.S. Ser. No. 763,030, filed Sep.30, 1991) (hereinafter designated Maskasky VI), discloses preparing an emulsion for photographic use comprised of silver halide grains and a gelatino-peptizer dispersing medium in which morphologically unstable tabular grains having {111} major faces account for greater than 50 percent of total grain projected area and contain at least 50 mole percent chloride, based on silver. The emulsion additionally contains at least one 2-hydroaminoazine adsorbed to and morphologically stabilizing the tabular grains. The 2-hydroaminoazine is protonated and thereby released from the tabular grain surfaces into the dispersing medium. The released 2-hydroaminoazine is replaced on the tabular grain surfaces by adsorption of a photographically useful compound selected from among those that contain at least one divalent sulfur atom, thereby concurrently morphologically stabilizing the tabular grains and enhancing their photographic utility, and the released 2-hydroaminoazine is removed from the dispersing medium.

SUMMARY OF THE INVENTION

In one aspect this invention is directed to a process preparing an emulsion for photographic use comprising (1) forming an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, the emulsion additionally containing at least one grain growth modifier adsorbed to and morphologically stabilizing the tabular grains, and (2) adsorbing to surfaces of the tabular grains a photographically useful compound.

The process is characterized in that (a) the grain growth modifier is a xanthinoid compound which satisfies the formula:

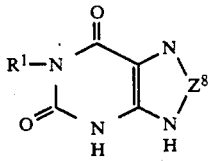

where $Z^8$ is $-C(R^8)=$ or $-N=$;

$R^8$ is H, $NH_2$ or $CH_3$; and $R^1$ is hydrogen or a hydrocarbon containing from 1 to 7 carbon atoms; (b) the pH of the dispersing medium is reduced below 3.0 to inactivate the xanthinoid as a morphological stabilizer, and (c) the inactivated xanthinoid is replaced on the tabular grain surfaces by adsorption of the photographically useful compound, the photographically useful compound being selected from among those containing at least one divalent sulfur atom, thereby concurrently morphologically stabilizing the tabular grains and enhancing their photographic utility.

The present invention is based on the recognition that, while the xanthinoid compounds are particularly useful during high chloride tabular grain formation and growth, there are other compounds that, when adsorbed to the tabular grain surfaces, can maintain their desired tabularity as well as enhance the photographic imaging properties of the emulsion during storage, exposure and/or processing. Adsorbed photographically useful compounds have been observed to be effective morphological stabilizers when they contain at least one divalent sulfur atom.

However, since the photographic useful compounds depend upon adsorption for their utility, the adsorbed xanthinoid compounds on the grains as initially formed are competing for grain surfaces when the photographically useful compound is later added to the emulsion. The present invention offers a procedure for inactivating xanthinoid compounds so that the photographically useful compound can be better adsorbed to the tabular grain surfaces.

DESCRIPTION OF PREFERRED EMBODIMENTS

The present invention is directed to a process of improving for photographic use the properties of a high chloride tabular grain emulsion in which the tabular grains have major faces lying in {111} crystallographic planes and rely on a xanthinoid compound adsorbed to surfaces of the tabular grains for morphological stabilization. Processes for preparing these emulsions are disclosed by Maskasky et al, cited above, and described in greater detail below.

The emulsions contain in addition to the grains and adsorbed xanthinoid a conventional dispersing medium for the grains The dispersing medium is invariably an aqueous medium and in the overwhelming majority of applications contains a gelatino-peptizer. In the practice of the invention the pH of the dispersing medium is lowered until the xanthinoid adsorbed to the tabular grain surfaces is inactivated. It is believed that the xanthinoid exists in equilibrium with an anionic deprotonated form which is capable of adsorbing to and thereby stabilizing the grains. Reducing pH shifts the equilibrium away from the adsorbed anionic form and thereby inactivates the xanthinoid as a morphological stabilizer.

The inactivated xanthinoid is replaced on the tabular grain surfaces with any one or combination of known photographically useful addenda known to adsorb to grain surfaces. By selecting photographically useful addenda for incorporation that contain at least one divalent sulfur atom the morphological stabilization function performed by the xanthinoid prior to protonation and release is performed while the known photographic utility of the replacement adsorbed compound is also realized. In other words the replacement adsorbed compounds is now performing at least two distinct functions.

After the replacement compound has been adsorbed to the tabular grain surfaces, the emulsion can be returned, if desired, to its initial pH or to any other convenient conventional pH for further preparation for photographic use.

Preferred high chloride tabular grain emulsions prepared in the practice of the invention contain tabular grains accounting for at least 50 percent of total grain projected that contain at least 50 mole percent chloride, based on total silver The tabular grains preferably contain less than 5 mole percent iodide. Bromide can account for the balance of the halide. In other words, the invention is applicable to emulsions in which the high chloride tabular grains are silver chloride, silver iodochloride, silver bromochloride, silver bromoiodochloride and/or silver iodobromochloride tabular grains. The chloride content of the tabular grains is preferably at least 80 mole percent and optimally at least 90 mole percent, based on total silver while the iodide content is preferably less than 2 mole percent and optimally less than 1 mole percent. When more than one halide ion is present in the tabular grains, the halides can be uniformly or nonuniformly distributed.

The photographic advantages of tabular grains are a function of their tabularity. Preferred emulsions in which the tabular grains exhibit a high mean tabularity—that is, they satisfy the mean tabularity relationship:

$$\frac{EDC}{t^2} > 25$$

where

ECD is the mean effective circular diameter of the high chloride tabular grains in μm and t is the mean thickness of the high chloride tabular grains in μm.

In terms of mean aspect ratios the high chloride tabular grains preferably exhibit high aspect ratios—that is, ECD/t>8. When high aspect ratio tabular grains exhibit a thickness of 0.3 μm or less, the grains also exhibit high tabularity. When the thickness of the tabular grains 0.2 μm or less high tabularities can be realized at intermediate aspect ratios of 5 or more. Maximum mean tabularities and mean aspect ratios are a function of the mean ECD of the high chloride tabular grains and their mean thickness. The mean ECD of the high chloride tabular grains can range up to the limits of photographic utility (that is, up to about 10 μm), but are typically 4 μm or less.

In preferred embodiments the processes of preparing high chloride high aspect ratio tabular grain emulsions of this invention employ a grain growth modifiers satisfying the formula:

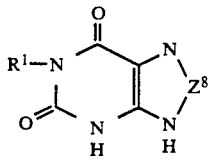

(I)

where $Z^8$ is $—C(R^8)=$ or $—N=$;

$R^8$ is H, $NH_2$ or $CH_3$; and $R^1$ is hydrogen or a hydrocarbon of from 1 to 7 carbon atoms.

The grain growth modifiers of formula I are xanthine and 8-azaxanthine grain growth modifiers, herein referred to generically as xanthinoids or xanthinoid compounds.

When the grain growth modifier is chosen to have a xanthine nucleus, the structure of the grain growth modifier is as shown in the following formula:

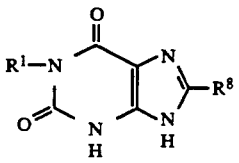

(II)

When the grain growth modifier is chosen to have an 8-azaxanthine nucleus, the structure of the grain growth modifier is as shown in the following formula:

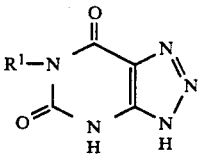

(III)

No substituents of any type are required on the ring structures of formulae I to III. Thus, each of $R^1$ and $R^8$ can in each occurrence be hydrogen. $R^8$ can in addition include a sterically compact hydrocarbon substituent, such as $CH_3$ or $NH_2$. $R^1$ can additionally include a hydrocarbon substituent of from 1 to 7 carbon atoms. Each hydrocarbon moiety is preferably an alkyl group—e.g., methyl, ethyl, n-propyl, i-propyl, n-butyl, i-butyl, t-butyl, etc. , although other hydrocarbons, such as cyclohexyl or benzyl, are contemplated. To increase grain growth modifier solubility the hydrocarbon groups can, in turn, be substituted with polar groups, such as hydroxy, sulfonyl or amino groups, or the hydrocarbon groups can be substituted with other groups that do not materially modify their properties (e.g., a halo substituent), if desired.

An aqueous gelatino-peptizer dispersing medium is present during precipitation. Gelatino-peptizers include gelatin—e.g., alkali-treated gelatin (cattle bone and hide gelatin) or acid-treated gelatin (pigskin gelatin) and gelatin derivatives—e.g., acetylated gelatin, phthalated gelatin, and the like.

The process of the invention is not restricted to use with gelatino-peptizers of any particular methionine content. That is, gelatino-peptizers with all naturally occurring methionine levels are useful. It is, of course, possible, though not required, to reduce or eliminate methionine, as taught by Maskasky II or King et al, both cited above and here incorporated by reference.

During the precipitation of photographic silver halide emulsions there is always a slight stoichiometric excess of halide ion present. This avoids the possibility of excess silver ion being reduced to metallic silver and resulting in photographic fog. It is a significant advantage of this invention that the stoichiometric excess of chloride ion in the dispersing medium can be maintained at a chloride ion concentration level of less than 0.5M while still obtaining a high aspect ratio tabular grain emulsion. It is generally preferred that the chloride ion concentration in the dispersing medium be less than 0.2M and, optimally, equal to or less than 0.1M.

The advantages of limiting the stoichiometric excess of chloride ion present in the reaction vessel during precipitation include (a) reduction of corrosion of the equipment (the reaction vessel, the stirring mechanism, the feed jets, etc.), (b) reduced consumption of chloride ion, (c) reduced washing of the emulsion after preparation, and (d) reduced chloride ion in effluent. It has also been observed that reduction in the chloride ion excess contributes to obtaining thinner tabular grains The grain growth modifiers of the invention are effective over a wide range of pH levels conventionally employed during the precipitation of silver halide emulsions. It is contemplated to maintain the dispersing medium within conventional pH ranges for silver halide precipitation, typically from 3 to 9, while the tabular grains are being formed, with a pH range of 4.5 to 8 being in most instances preferred. Within these pH ranges optimum performance of individual grain growth modifiers can be observed as a function of their specific structure. A strong mineral acid, such as nitric acid or sulfuric acid, or a strong mineral base, such as an alkali hydroxide, can be employed to adjust pH within a selected range. When a basic pH is to be maintained, it is preferred not to employ ammonium hydroxide, since it has the unwanted effect of acting as a ripening agent and is known to thicken tabular grains. However, to the extent that thickening of the tabular grains does not exceed the 0.3 μm thickness limit, ammonium hydroxide or other conventional ripening agents (e.g., thioether or thiocyanate ripening agents) can be present within the dispersing medium.

Any convenient conventional approach of monitoring and maintaining replicable pH profiles during repeated precipitations can be employed (e.g., refer to Research Disclosure Item 308,119, cited below). Maintaining a pH buffer in the dispersing medium during precipitation arrests pH fluctuations and facilitates maintenance of pH within selected limited ranges. Exemplary useful buffers for maintaining relatively narrow pH limits within the ranges noted above include sodium or potassium acetate, phosphate, oxalate and phthalate as well as tris(hydroxymethyl)aminomethane.

For tabular grains to satisfy the projected area requirement it is necessary first to induce twinning in the grains as they are being formed, since only grains having two or more parallel twin planes will assume a tabular form. Second, after twinning has occurred, it is necessary to restrain precipitation onto the major {111} crystal faces of the tabular grains, since this has the effect of thickening the grains. The grain growth modifiers employed in the practice of this invention are effective during precipitation to produce an emulsion satisfying both the tabular grain thickness and projected area parameters noted above.

It is believed that the effectiveness of the grain growth modifiers to induce twinning during precipitation results from the spacing of the required nitrogen atoms in the fused five and six membered heterocyclic rings and their ability to form silver salts. This can be better appreciated by reference to the following structure:

(IV)

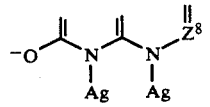

C. Cagnon et al, Inorganic Chem., 16:2469 (1977) reports a silver salt satisfying the nitrogen atom and silver pairing arrangement of formula IV and provides bond lengths establishing the spacing between the adjacent silver atoms of the formula. Based on the crystal structure of silver chloride revealed by X-ray diffraction it is believed that the resulting spacing between the silver ions is much closer to the nearest permissible spacing of silver ions in next adjacent {111} silver ion crystal lattice planes separated by a twin plane than the nearest spacing of silver ions in next adjacent {111} silver ion crystal lattice planes not separated by a twin plane. Thus, when one of the silver ions shown above is positioned during precipitation in a {111} silver ion crystal lattice plane, assuming a sterically compatible location (e.g., an edge, pit or coign position) is occupied, the remaining of the silver ions shown above favors a position in the next {111} silver ion crystal lattice plane that is permitted only if twinning occurs. The remaining silver atom of the growth modifier (together with other similarly situated growth modifier silver ions) acts to seed (enhance the probability of) a twin plane being formed and growing across the {111} crystal lattice face, thereby providing a permanent crystal feature essential for tabular grain formation.

It is, of course, also important that the ring substituents next adjacent the ring nitrogen shown in formula IV be chosen to minimize any steric hindrance that would prevent the silver ions from having ready access to the {111} crystal lattice planes as they are being formed. A further consideration is to avoid substituents to the ring positions next adjacent the ring nitrogen shown that are strongly electron withdrawing, since this creates competition between the silver ions and the adjacent ring position for the $\pi$ electrons of the nitrogen atoms. When $Z^8$ is —N= or —CH=, an optimum structure for silver ion placement in the crystal lattice exists. When $Z^8$ is —C($R^8$)= and $R^8$ is a compact substituent, as described above, twin plane formation is readily realized. In formula IV the ring positions separated from the ring nitrogen by an intervening ring position are not shown, these ring positions and their substituents are not viewed as significantly influencing twin plane formation.

In addition to selecting substituents for their role in twin plane formation, they must also be selected for their compatibility with promoting the formation of {111} crystal faces during precipitation. By selecting substituents as described above the emergence of {100}, {110} and higher index crystal plane faces of the types described by Maskasky U.S. Pat. Nos. 4,643,966, 4,680,254, 4,680,255, 4,680,256 and 4,724,200, is avoided.

Once a stable multiply twinned grain population has been formed within the dispersing medium, the primary, if not exclusive, function the grain growth modifier is called upon to perform is to restrain precipitation onto the major {111} crystal faces of the tabular grains, thereby retarding thickness growth of the tabular grains. In a well controlled tabular grain emulsion precipitation, once a stable population of multiply twinned grains has been produced, tabular grain thicknesses can be held essentially constant.

The amount of grain growth modifier required to control thickness growth of the tabular grain population is a function of the total grain surface area. By adsorption onto the (111} surfaces of the tabular grains the grain growth modifier restrains precipitation onto the grain faces and shifts further growth of the tabular grains to their edges.

The benefits of this invention can be realized using any amount of grain growth modifier that is effective to retard thickness growth of the tabular grains. It is generally contemplated to have present in the emulsion during tabular grain growth sufficient grain growth modifier to provide a monomolecular adsorbed layer over at least 25 percent, preferably at least 50 percent, of the total (111) grain surface area of the emulsion grains Higher amounts of adsorbed grain growth modifier are, of course, feasible. Adsorbed grain growth modifier coverages of 80 percent of monomolecular layer coverage or even 100 percent are contemplated. In terms of tabular grain thickness control there is no significant advantage to be gained by increasing grain growth modifier coverages above these levels.

Prior to introducing silver salt into the dispersing medium at the outset of the precipitation process, no grains are present in the dispersing medium, and the initial grain growth modifier concentrations in the dispersing medium are therefore more than adequate to provide the monomolecular coverage levels noted above as grains are initially formed. As tabular grain growth progresses it is a simple matter to add grain growth modifier, as needed, to maintain monomolecular coverages at desired levels, based on knowledge of amount of silver ion added and the geometrical forms of the grains being grown. If, as noted above, grain growth modifier has been initially added in excess of its solubility limit, undissolved grain growth modifier can enter solution as dissolved grain growth modifier is depleted from the dispersing medium by adsorption on grain surfaces. This can reduce or even eliminate any need to add grain growth modifier to the reaction vessel as grain growth progresses.

Inactivation of the xanthinoid adsorbed to the high chloride tabular grain surfaces to facilitate replacement with a selected photographically useful compound can be achieved merely by lowering the pH of emulsion. pH is preferably lowered using the same mineral acids (e.g., sulfuric acid or nitric acid) conventionally used to adjust pH during emulsion precipitation. It is contemplated to lower the pH of the dispersing medium less than 3.0 to inactivate the xanthinoid compounds. While different xanthinoid compounds are inactivated at a slightly different pH, inactivation of preferred compounds can be achieved effected within the pH range of from 2.9 to 0.5, most preferably from 2.5 to 1.0. Inactivation in these ranges is highly advantageous, since it allows the common pH ranges of emulsion precipitation to be employed and allows inactivation to be achieved without subjecting the emulsions to extremely acidic conditions that could degrade other components.

In choosing photographically useful compounds containing at least one divalent sulfur atom to replace the protonated and released xanthinoid as a morphological stabilizer on the tabular grain surfaces a wide variety of conventional photographically useful emulsion addenda are available to choose among. Spectral sensitizing dyes, desensitizers, hole trapping dyes, antifoggants, stabilizers and development modifiers are illustrations of different classes of photographically useful compounds that can be selected to contain one or more divalent sulfur atom containing moieties. A wide variety of photographically useful compounds containing one or more divalent sulfur atoms is disclosed in Research Disclosure, Item 308119, cited above and here incorporated by reference.

The following are illustrative of varied divalent sulfur atom moieties commonly found in photographically useful compounds:

M-1 —S—H
mercapto

M-2 —S—$R^a$ where $R^a$ is any convenient hydrocarbon or substituted hydrocarbon—e.g., when $R^a$ an alkyl group the resulting moiety is an alkylthia moiety (methyltia, ethylthia, propylthia, etc.) when $R^a$ is an aromatic group the resulting moiety is an arylthia moiety (phenylthia, naphthylthia, etc.) or $R^a$ can be a heterocyclic nucleus, such as any of the various heterocyclic nuclei found in cyanine dyes.

| | |
|---|---|
| M-3 | —S—S—$R^a$ where $R^a$ is as described above |
| M-4 | 1,4-thiazine |
| M-5 | thiazoline |
| M-6 | thiazole |
| M-7 | thiophene |
| M-8 | 3-thia-1,4-diazole |
| M-9 | benzothiazole |
| M-10 | naphtho[2,1-d]thiazole |
| M-11 | naphtho[1,2-d]thiazole |
| M-12 | naphtho[2,3-b]thiazole |
| M-13 | thiazolo[4,5-b]quinoline |
| M-14 | 4,5-dihydrobenzothiazole |
| M-15 | 4,5,6,7-tetrahydrobenzothiazole |
| M-16 | 4,5-dihydronaptho[1,2-d]thiazole |
| M-17 | phenanthrothiazole |
| M-18 | acenaphthothiazole |
| M-19 | isorhodanine |
| M-20 | rhodanine |
| M-21 | thiazolidin-2,4-dione |
| M-22 | thiazolidin-2,4-dithione |
| M-23 | 2-dicyanomethylenethiazolidin-4-one |
| M-24 | 2-diphenylamino-1,3-thiazolin-4-one |
| M-25 | benzothiophen-3-one |

the moieties M-1 to M-8 as well as some of the subsequent moieties, such as M-9 and M-20, are commonly encountered in various photographically useful compounds such as antifoggants, stabilizers and development modifiers. The moieties M-5 to M-18 are common heterocyclic nuclei in polymethine dyes, particularly cyanine and merocyanine sensitizing dyes. The moieties M-19 to M-25 are common acidic nuclei in merocyanine dyes. The heterocyclic moieties M-4 to M-25 are named as rings, since the site of ring attachment can be at any ring carbon atom and ring, substituents, if any, can take any convenient conventional form, such as any of the various forms described above in connection with $R^a$.

The photographically useful compound containing one or more divalent sulfur atom containing moieties is introduced into the dispersing medium in an amount sufficient to provide at least 20 percent of monomolecular coverage on the grain surfaces. It is preferred to introduce the photographically useful compound in a concentration sufficient to provide from 50 to 100 percent of monomolecular coverage. Introducing greater amounts of the photographically useful compound than can be adsorbed on grain surfaces is inefficient, since unadsorbed compound is susceptible to removal from the emulsion during subsequent washing. If higher concentrations of the divalent sulfur atom containing compound are desired to satisfy its photographic utility unrelated to morphological grain stabilization, further addition of the compound can be undertaken at any convenient point in preparation of the photographic element—e.g., after washing, prior to coating, etc.

It is generally preferred to dissolve in the dispersing medium of the emulsion the photographically useful compound intended to replace the xanthinoid on the grain surfaces before inactivation of the latter is undertaken. In this arrangement the compound adsorbs to the grain surfaces as the xanthinoid vacates grain surface sites. This entirely precludes any risk of morphological degradation of the tabular grains by reversion to {100} crystal faces.

As an alternative it is specifically contemplated to lower the pH of the dispersing medium immediately before introduction of the divalent sulfur atom containing compound. This latter approach has the advantage of allowing divalent sulfur atom containing compounds that have limited solubility in the dispersing medium to be adsorbed to the grains in preference to precipitation within the dispersing medium Thus, whether introduction of the divalent sulfur atom containing compound is optimally undertaken before or after the pH is lowered is a function of the particular compound being employed and particularly its solubility and rate of precipitation.

The xanthinoid compound can be released from the grain surfaces before or after chemical sensitization. The addition of a photographically useful compound, such as a spectral sensitizing dye or an antifoggatt, to an emulsion before chemical sensitization is a common practice and entirely compatible with the practice of this invention.

Apart from the features of the invention that have been specifically described, the emulsions and their preparation can take any convenient conventional form. Research Disclosure,Vol. 308, December 1989, Item 308119, is here incorporated by reference for its disclosure of conventional emulsion features, and attention is specifically directed to Sections IV, VI and XXI.

EXAMPLES

The invention can be better appreciated by reference to the following specific embodiments.

The mean thickness of tabular grain populations was measured by optical interference for mean thicknesses >0.06 μm measuring more than 1000 tabular grains.

The terms ECD and t are employed as noted above; r.v. represents reaction vessel; GGM is the acronym for grain growth modifier; TGPA indicates the percentage of the total grain projected area accounted by tabular grain of less than 0.3 μm thickness.

EXAMPLE 1

AgCl High Aspect Ratio Tabular Grain Emulsions Precipitated at pH 6.2

To a stirred reaction vessel containing 300 mL of a solution at 75° C. that was 2.7% in bone gelatin, 0.053M in NaCl, and 2.7M in sodium acetate was added 100 mL of 12 mM basic xanthine solution. The pH of the resulting solution was adjusted to 6.2. A 4M silver nitrate solution and a 4M NaCl solution were added. The silver nitrate solution was added at 0.25 mL/min for 4 min then its flow was stopped for 15 minutes then resumed at 0.25 mL/min for 2 min. The flow rate was then accelerated over an additional period of 30 min (20 × from start to finish) and finally held constant at 5 mL/min until 0.4 mole of silver nitrate was added. The NaCl solution was added at a similar rate as needed to maintain a constant pAg of 6.65. When the pH dropped 0.2 units below the starting value of 6.2, the pH was adjusted back to the starting value.

EXAMPLE 1B

This emulsion was prepared similar to that of Example 1A, except that the precipitation was stopped after 0.27 mole of silver nitrate had been added. The results are given in Table I.

EXAMPLE 1C

This emulsion was prepared similar to that of Example 1, except that the precipitation was stopped after 0.13 mole of silver nitrate had been added. The results are given in Table I.

EXAMPLE 2

AgCl High Aspect Ratio Tabular Grain Emulsions Precipitated at pH 7.0

A reaction vessel, equipped with a stirrer, was charged with 5600 g of distilled water containing 50 g of oxidized gelatin containing <4 μmole methionine per gram gelatin, 2 grams of xanthine, 2.5 g of NaCl and 1 mL of an antifoamant. The pH was adjusted to 7.0 at 80° C. and maintained at that value throughout the precipitation by additions of sodium hydroxide or nitric acid. A 4M silver nitrate solution was added over a period of 2.5 min at a rate consuming 1.0% of the total Ag used. The flow was stopped for 40 min and followed by addition of 120 g of 4M NaCl solution. Then 4M silver nitrate and 4M NaCl solutions were added simultaneously with linearly accelerated addition rates over a period of 40 minutes (5× from start to finish) during which time the remaining 99% of silver was consumed. The pAg of the emulsion was maintained at 6.28 during the last 40 minutes of the precipitation. The total silver precipitated was 3.88 moles. The results are presented in Table I.

EXAMPLE 3

AgCl High Aspect Ratio Tabular Grain Emulsions Precipitated at pH 5.3

The precipitation conditions of this example were the same as those of Example 2, except that 5 g of xanthine was used, the reaction vessel was maintained at pH 5.3 and at 75° C., the pAg during growth was maintained at 6.61, and the total silver precipitated was 4.11 moles. The results are summarized in Table I.

Example 4

AgCl High Aspect Ratio Tabular Grain Emulsions Precipitated at pH 6.0 and 40° C.

The precipitation conditions of this example were the same as those of Example 2, except that 5 g of xanthine were used, the reaction vessel was maintained at pH 6.0 and at 40° C., and the pAg during growth was maintained at 7.74. The results are presented in Table I.

EXAMPLE 5

AgBrCl (=10 Mole% Br) High Aspect Ratio Tabular Grain Emulsions

EXAMPLE 5

10.2M% Br

To a stirred reaction vessel containing 300 mL of a solution at 75° C. that was 2.7% in bone gelatin, 0.040M in NaCl, 2.7 mM in NaBr and 2.7M in sodium acetate were added 100 mL of a 12 mM basic xanthine solution. The pH of the resulting solution was adjusted to 6.2. A solution 4M in silver nitrate, a salt solution 3.6M in NaCl, and 0.4M in NaBr were added to the reaction vessel at 75° C. The Silver nitrate solution was added at 0.25 mL/min for 1 min then its flow rate was accelerated at 0.158 mL/min/min until 0.27 mole of silver nitrate was added, requiring a total of 29 min. The salt solution was added at a similar rate, but as needed to maintain a constant pAg of 6.65. When the pH dropped 0.2 units below the starting value of 6.2, the flow of solutions was momentarily stopped, and the pH was adjusted back to the starting value. The results are presented in Table I.

EXAMPLE 5B

10.8 Mole% Br

This emulsion was prepared similar to that of Example 5A, except that the precipitation was stopped after 0.13 mole of silver nitrate had been added. The results are summarized in Table I.

CONTROL 6

Attempt to use Uric Acid to form High Aspect Ratio AgCl Tabular Grain Emulsions

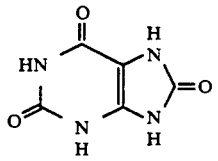

Uric Acid

CONTROL 6A pH 6.2

This emulsion was prepared similar to that of Example 1A, except that 100 mL of a 12 mM basic uric acid solution was added to the reaction vessel in place of the xanthine solution A nontabular grain emulsion resulted.

CONTROL 6B pH 4.5

This emulsion was prepared similar to that of Control 6A, except that the pH was maintained at 4.5. A nontabular grain emulsion resulted.

CONTROL 7

Attempt to use Guanine to form a High Aspect Ratio AgCl Tabular Grain Emulsion

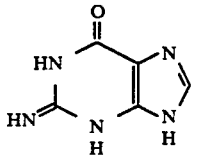

Guanine

This emulsion was prepared similar to that of Example 1A, except that 100 mL of a 12 mM acidic guanine solution was added to the reaction vessel in place of the xanthine solution A nontabular grain emulsion resulted.

CONTROL 8

Attempt to use Hypoxanthine to form a High Aspect Ratio AgCl Tabular Grain Emulsion

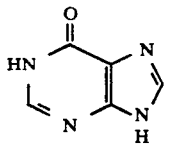

Hypoxanthine

The emulsion was prepared similar to that of Example 1A, except that the xanthine solution was replaced with 100 mL of a 12 mM basic hypoxhanthine solution. A nontabular grain emulsion resulted.

TABLE I

| Example | pH | Temp (°C.) | $AgNO_3$ added (mole) | Final GGM per Ag (mmole/mole) | Projected area as fine grains * (%) | Tabular Grain Population: Mean ECD (μm) | Mean t (μm) | Mean Aspect ratio | % TPGA |
|---|---|---|---|---|---|---|---|---|---|
| 1A | 6.2 | 75 | 0.40 | 3.0 | 2 | 2.87 | 0.170 | 16.9 | 85 |
| 1B | 6.2 | 75 | 0.27 | 4.4 | 10 | 2.40 | 0.125 | 19.2 | 80 |
| 1C | 6.2 | 75 | 0.13 | 9.2 | 20 | 2.07 | 0.093 | 22.3 | 70 |
| 2 | 7.0 | 80 | 3.90 | 3.4 | 0 | 3.20 | 0.15 | 21.3 | 85 |
| 3 | 5.3 | 75 | 4.10 | 8.0 | 10 | 2.30 | 0.25 | 9.2 | 85 |
| 4 | 6.0 | 40 | 3.90 | 8.5 | 10 | 1.10 | 0.087 | 12.6 | 90 |
| 5A | 6.0 | 75 | 0.27 | 4.4 | 10 | 2.40 | 0.120 | 20.0 | 85 |
| 5B | 6.0 | 75 | 0.13 | 9.2 | 20 | 1.83 | 0.091 | 20.1 | 75 |

*ECD <0.2 μm
5A = 10.2 mole % AgBr;
5B = 10.6 mole % AgBr

EXAMPLE 9

Replacement of the Grain Growth Modifier with Divalent Sulfur Atom Containing Compounds The emulsion of Example 1 was remade. The tabular grains had an ECD of 3.07 μm, a mean thickness of 0.2 μm and an average aspect ratio of 15.3. The tabular grains accounted for 85 percent of total grain projected areas.

To 0.025 mole portions of the above AgCl tabular grain emulsion was added distilled water to 50 g. A stabilizer solution was added as indicated in Table II, the mixture was stirred for 30 min at 40° C., and the pH was then lowered to 2.0 with nitric acid. After stirring for 15 min at low pH, a small portion of each was examined to determine if the treated emulsions were still high aspect ratio tabular grain emulsions. They were then heated for 15 min at 60° C. and again examined for tabularity. The results are summarized in Table II.

TABLE II

| Example | Type | Stabilizer Amount (mmole/mole Ag) | Calc. % Monolayer Coverage | Low pH Treatment: 40° C. | 60° C. |
|---|---|---|---|---|---|
| Control 9A | none | 0 | 0 | non-tabular | non-tabular |
| Example 9B | Compound A | 0.65 | 32% | tabular | tabular |
| Example | Compound | 0.20 | 31% | tabular | tabular |

TABLE II-continued

| Example | Type | Stabilizer Amount (mmole/ mole Ag) | Calc. % Monolayer Coverage | Low pH Treatment 40° C. | 60° C. |
|---|---|---|---|---|---|
| 9C | B | | | | |
| Example 9D | Compound B | 0.40 | 62% | tabular | tabular* |

*A coating of this emulsion gave an absorptance maximum at 479 nm indicating that the dye adsorbed as a J-aggregate.
Compound A. 1-(3-acetaminodophenyl)-5-mercaptotetrazole, sodium salt
Compound B. anhydro-5-chloro-3,3'-di(3-sulfopropyl)-naphthol[1,2-d]thiazolothiacyanine hydroxide, triethylammonium salt The invention has been described in detail with particular reference to preferred embodiments thereof, but it will be understood that variations and modifications can be effected within the spirit and scope of the invention.

What is claimed is:

1. A process of preparing an emulsion for photographic use comprising (1) forming an emulsion comprised of silver halide grains and a gelatino-peptizer dispersing medium in which morphologically unstable tabular grains having {111} major faces account for greater than 50 percent of total grain projected area and contain at least 50 mole percent chloride, based on silver, the emulsion additionally containing at least one grain growth modifier adsorbed to an morphologically stabilizing the tabular grains, and (2) adsorbing to surfaces of the tabular grains a photographically useful compound,

CHARACTERIZED IN THAT the emulsion is formed in the presence of a stoichiometric excess of chloride ion having a chloride ion concentration of less than 0.5M, the morphological stabilizer being in an amount sufficient to provide a monomolecular layer adsorbed to at least 25 percent of the surface area of the emulsion grains, the grain growth modifier is a xanthinoid which satisfies the formula:

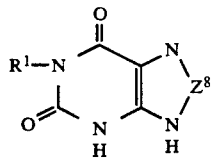

where $Z^8$ is $—C(R^8)=$ or $—N=$;

$R^8$ is H, $NH_2$ or $CH_3$; and $R^1$ is hydrogen or a hydrocarbon containing from 1 to 7 carbon atoms;

the pH of the dispersing medium is reduced below 3.0 to inactivate xanthinoid as a morphological stabilizer, and the inactivated xanthinoid is replaced on the tabular grain surfaces by adsorption of the photographically useful compound, the photographically useful compound being selected from among those containing at least one divalent sulfur atom, thereby concurrently morphologically stabilizing the tabular grains and enhancing their photographic utility.

2. A process according to claim 1 further characterized in that the tabular grains are chemically sensitized prior to inactivating the xanthinoid compound.

3. A process according to claim 1 further characterized in that the photographically useful compound is present in the emulsion prior to inactivating the xanthinoid compound.

4. A process according to claim 3 further characterized in that the emulsion is chemically sensitized after the xanthionid compound is inactivated.

5. A process according to claim 1 further characterized in that the photographically useful compound is a spectral sensitizing dye.

6. A process according to claim 5 further characterized in that the spectral sensitizing dye contains a thiazoline, thiazole, thiophene, rhodanine or isorhodanine ring.

7. A process according to claim 6 further characterized in that the spectral sensitizing dye includes a benzothiazole, napthothiazole, phenanthrothiazole or acenapthothiazole nucleus.

8. A process according to claim 1 further characterized in that the photographically useful compound is an antifoggant or stabilizer.

9. A process according to claim 1 further characterized in that the photographically useful compound includes a mercapto, alkylthia or arylthia moiety.

10. A process according to claim 1 further characterized in that the xanthinoid compound satisfies the formula:

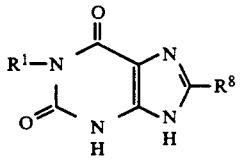

$R^8$ is H, $NH_2$ or $CH_3$; and $R^1$ is hydrogen or a hydrocarbon containing from 1 to 7 carbon atoms.

11. A process according to claim 1 further characterized in that the xanthinoid compound satisfies the formula:

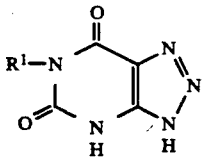

$R^1$ is hydrogen or a hydrocarbon containing from 1 to 7 carbon atoms.

* * * * *